US006621210B2

(12) United States Patent
Kato et al.

(10) Patent No.: US 6,621,210 B2
(45) Date of Patent: Sep. 16, 2003

(54) FRONT PLATE FOR FIELD-EMISSION DISPLAY COMPRISING BARRIERS FORMED OF CONDUCTIVE INORGANIC MATERIAL

(75) Inventors: Haruo Kato, Aichi-Ken (JP); Tsunenari Saito, Tokyo-To (JP); Shinzo Hirata, Tokyo-To (JP); Kazuyoshi Togashi, Tokyo-To (JP)

(73) Assignees: Sony Corporation (JP); Dai Nippon Printing Co., Ltd. (JP)

( * ) Notice: Subject to any disclaimer, the term of this patent is extended or adjusted under 35 U.S.C. 154(b) by 34 days.

(21) Appl. No.: 09/903,870

(22) Filed: Jul. 13, 2001

(65) Prior Publication Data

US 2002/0043924 A1 Apr. 18, 2002

(30) Foreign Application Priority Data

Jul. 14, 2000 (JP) ..... 2000-213774

(51) Int. Cl.[7] ..... H01J 1/62; H01J 63/04

(52) U.S. Cl. ..... 313/496; 313/495; 313/609; 313/610

(58) Field of Search ..... 313/495, 496, 313/505, 609, 610

(56) References Cited

U.S. PATENT DOCUMENTS 5,477,105 A * 12/1995 Curtin et al. ..... 313/422
5,510,678 A * 4/1996 Sakai et al. ..... 315/58
5,701,056 A * 12/1997 Shinohara ..... 313/584
5,783,904 A 7/1998 Liu et al. ..... 313/495
5,859,508 A * 1/1999 Ge et al. ..... 315/366
5,963,284 A * 10/1999 Jones et al. ..... 349/112
6,208,404 B1 * 3/2001 Tomoyori et al. ..... 349/187
6,215,243 B1 * 4/2001 Janning ..... 313/496
6,255,772 B1 * 7/2001 Cathey et al. ..... 313/495
6,387,600 B1 * 5/2002 Hanson ..... 430/316
6,448,709 B1 * 9/2002 Chuang et al. ..... 313/497

FOREIGN PATENT DOCUMENTS

| | | | | |
|---|---|---|---|---|
| EP | 0 690 467 A1 | | 1/1996 | |
| JP | 02242548 A | * | 9/1990 | ..... H01J/17/16 |
| JP | 09073869 | | 3/1997 | |
| JP | 10040837 | | 2/1998 | |
| WO | WO 99/00822 | | 1/1999 | |
| WO | WO 99/36937 | | 7/1999 | |

* cited by examiner

*Primary Examiner*—Vip Patel
*Assistant Examiner*—Kevin Quarterman
(74) *Attorney, Agent, or Firm*—Parkhurst & Wendel, L.L.P.

(57) ABSTRACT

A front plate for a field-emission display includes a transparent substrate, and a conductive black matrix provided with a plurality of apertures and formed on one of surfaces of the transparent substrate. Barriers are formed of conductive inorganic material on predetermined positions of the black matrix, adjacent to the apertures. Fluorescent layers are formed in the apertures of the black matrix on the transparent substrate.

11 Claims, 10 Drawing Sheets

FRONT PLATE FOR FIELD-EMISSION DISPLAY COMPRISING BARRIERS FORMED OF CONDUCTIVE INORGANIC MATERIAL

BACKGROUND OF THE INVENTION

1. Field of the Invention

The present invention relates to a front plate for a field-emission display.

2. Description of the Related Art

Generally, a field-emission display panel (FED panel) includes a back plate (cathode substrate) and a front plate (anode substrate). The back plate has a glass substrate, emitter electrodes, i.e., electron-emitting elements, formed on the glass substrate, an insulating layer formed over the emitter electrodes, and gate electrodes (extraction electrodes) arranged on the insulating layer perpendicularly to the emitter electrodes. The front plate has a glass substrate, anodes formed on the glass substrate, and fluorescent layers formed over the anodes. The back plate and the front plate are set opposite to each other and joined together with spacers held therebetween, and a space between the back plate and the front plate is evacuated. A predetermined voltage is applied across the emitter electrodes and the gate electrodes and, at the same time, a predetermined voltage is applied across the emitter electrodes and the anodes to make the emitter electrodes emit electrons and to make the electrons collide against the anodes. The fluorescent layers emit light to display an image when the electrons collide with the anodes.

In this FED panel, it is necessary to prevent the unnecessary light emission of the fluorescent layers of cells adjacent to those desired to emit light due to the scattering of electrons emitted by the emitter electrodes and the scattering of secondary electrons emitted as a result of bombardment of the anodes by the electrons to make the fluorescent layers emit light. Conductive barriers are formed between the cells of the front plate by forming a pattern of a height on the order of several tens micrometers so as to isolate the cells of the front plate from each other by processing a film of a polyimide resin or the like by photolithography, and coating the pattern with a metal thin film to prevent the electrons and the secondary electrons from scattering for preventing unnecessary light emission.

In the FED panel provided with such barriers in the front plate, the barriers produce a gas when the same are irradiated with an electron beam. Consequently, the vacuum is reduced, the electrodes of the back plate are deteriorated, the fluorescent layers are deteriorated and the reliability of the FED panel is reduced. When forming the fluorescent layers of the front plate by a fluorescent layer forming process, there is a limit to the process temperature because a material forming the barriers has a low heat resistance, only limited fluorescent materials can be used, and fluorescent layers having desired characteristics cannot be formed. The barriers of the electrically insulating polyimide resin or the like must be coated with the metal thin film to prevent charge-up due to bombardment of the same by secondary electrons, which needs a complicated process.

FED panels disclosed in JP-A Nos. Hei 9-73869 and Hei 10-40837 employ metal spacers for spacing the back plate and the front plate. The metal spacers solve problems caused by production of a gas by the conventional polyimide spacers and charge-up. If the spacers are formed in a pattern having parts formed between the cells, the spacers will function also as barriers.

The spacers of each of the FED panels disclosed in JP-A Nos. Hei 9-73869 and Hei 10-40837 are inevitably in contact with both the front and the back plate. Since the spacers are conductive, the spacers must be disposed relative to the front and the back plate so as not to be in contact with the anodes of the front plate, and the gate electrodes and the electron emitting elements of the back plate. Thus it is necessary to form spacer wiring lines connected to the spacers to maintain the spacers at a predetermined potential and to prevent charge-up in addition to the anodes, the gate electrodes and the electron emitting elements, which reduces the degree of freedom of design and makes fabricating process complicated.

Degree of freedom of design will be increased if, for example, the spacer wiring lines are formed on the front plate separately from the anodes, and an insulating layer is formed between the spacers formed on the spacer wiring lines and the gate electrodes of the back plate. However, it is highly possible that breakdown occurs in the insulating layer when a voltage in the range of several hundreds volt to several thousands volts is applied across the gate electrodes of the back plate and the spacer wiring lines. Thus the spacers employed in the prior art FED panels have problems in their practical application.

SUMMARY OF THE INVENTION

The present invention has been made in view of the foregoing circumstances and it is therefore an object of the present invention to provide a front plate for a field-emission display, capable of enhancing the reliability of the field-emission display and of being easily fabricated.

According to a first aspect of the present invention, a front plate for a field-emission display includes a transparent substrate, a conductive black matrix provided with a plurality of apertures and formed on one of the surfaces of the transparent substrate, a plurality of barriers formed at predetermined positions on the black matrix, and fluorescent layers formed in the apertures of the black matrix on the transparent substrate, wherein the barriers are formed of a conductive inorganic material.

Preferably, the conductive inorganic material is one of or one of combinations of metals of a metal group including nickel, cobalt, copper, iron, gold, silver, rhodium, palladium, platinum and zinc, one of alloys each of some of the metals of the metal group, or one of or one of combinations of some metal oxides of a metal oxide group including indium-tin oxide, indium-zinc oxide and tin oxide.

Preferably, an intermediate layer is formed between the barriers and the black matrix, and the intermediate layer has a middle thermal or strength characteristic between those of the transparent substrate and the barriers.

Preferably, the barriers contain particles having a coefficient of thermal expansion smaller than that of the conductive inorganic material.

Preferably, the barriers are formed by an electroplating process.

According to a second aspect of the present invention, a front plate for a field-emission display includes a transparent substrate, a plurality of barriers formed at predetermined positions on one of the surfaces of the transparent substrate, and fluorescent layers formed in desired regions in parts, not provided with the barriers, of the transparent substrate, wherein the barriers are formed of a conductive inorganic material, and the barriers are electrically connected by charge dissipating lines.

Preferably, the conductive inorganic material is one of or one of combinations of metals of a metal group including nickel, cobalt, copper, iron, gold, silver, rhodium, palladium, platinum and zinc, one of alloys each of some of the metals of the metal group, or one of or one of combinations of some metal oxides of a metal oxide group including indium-tin oxide, indium-zinc oxide and tin oxide.

Preferably, a conductive intermediate layer is formed between the barriers and the transparent substrate, and the intermediate layer has a middle thermal or strength characteristic between those of the transparent substrate and the barriers.

Preferably, a black matrix is formed between the barriers and the transparent substrate, the black matrix has a plurality of apertures, and the fluorescent layers are formed in the apertures on the transparent substrate.

Preferably, a conductive intermediate layer is formed between the barriers and the black matrix, and the intermediate layer has a middle thermal or strength characteristic between those of the transparent substrate and the barriers.

Preferably, the barriers are formed by an electroless plating process.

Preferably, the barriers are formed by an electroplating process on the intermediate layer.

Preferably, the barriers contain particles having a coefficient of thermal expansion smaller than that of the conductive inorganic material.

Preferably, the barriers have a height in the range of 20 to 100 $\mu$m and a width in the range of 10 to 50 $\mu$m.

DESCRIPTION OF THE PREFERRED EMBODIMENTS

Figure 1:
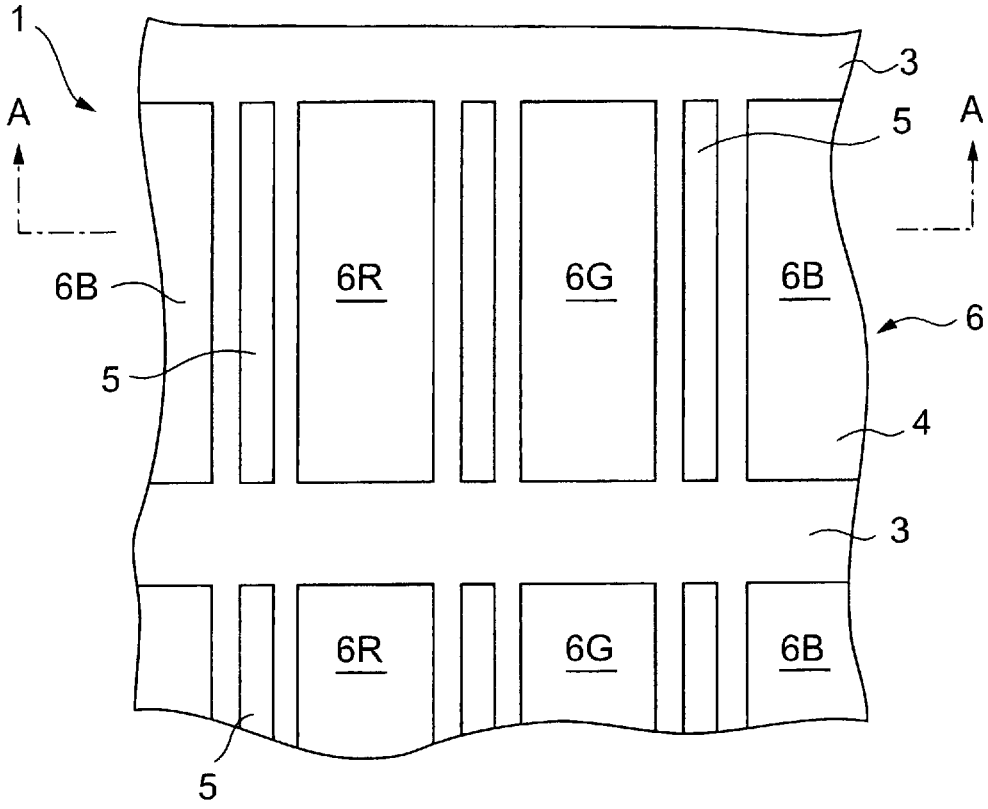
FIG. 1 is a fragmentary plan view of a front plate in a first embodiment according to the present invention for a field-emission display.

Preferred embodiments of the present invention will be described hereinafter with reference to the accompanying drawings.

First Embodiment

A front plate 1 in a first embodiment according to the present invention for a field-emission display will be described with reference to FIGS. 1 and 2. The front plate 1 has a transparent substrate 2, a black matrix 3 formed on one of the surfaces of the transparent substrate 2, and a plurality of barriers 5 formed on predetermined parts of the black matrix 3. Fluorescent layers 6 are formed in a plurality of apertures 4 formed in the black matrix 3. The transparent substrate 2 is a glass or quartz substrate generally employed in conventional field-emission displays. The transparent substrate 2 has a thickness in the range of about 0.5 to about 3.0 mm. The black matrix 3 is a black film having a low reflectivity. The black matrix 3 enhances the contrast of images displayed on the field-emission display. In this embodiment, the black matrix 3 is formed by patterning a conductive thin film capable of serving as a conducting circuit for electrically connecting the barriers 5 and making the front plate 1, i.e., an anode plate, in an equipotential state. The black matrix 3 is, for example, a film of chromium, a two-layer film of chromium and chromium oxide or a three-layer film, and has a thickness in the range of 0.04 to 0.2 $\mu$m. The black matrix 3 is formed by the steps of forming a film of a metal, such as chromium, nickel, aluminum, molybdenum or an alloy of some of those metals, or a metal oxide, such as chromium oxide or chromium nitride, on the transparent substrate 2 by a thin film forming process, such as a vacuum evaporation process, a sputtering process or the like, and forming a patterned mask on the film, and forming the apertures in the film by etching the film through the patterned mask. The black matrix 3 may be formed by a method comprising the steps of forming a film of a photosensitive on the transparent substrate by black paste containing a black pigment, conductive particles of silver or the like and glass frit, forming a mask of a predetermined pattern on the film, exposing the film to light through the mask, subjecting the exposed film to development, and baking the developed film to remove organic components.

The size and pitches of the apertures 4 of the black matrix 3 may be properly determined according to the length and pitches of electron-emitting elements (emitter electrodes) lying between the gate electrodes of a back plate 61 (FIG. 15) and the pitches of the gate electrodes. Although the apertures 4 in this embodiment have a rectangular shape, the apertures 4 may be formed in any proper shape, such as a polygonal shape or an elliptic shape.

The barriers 5 of the front plate 1 are formed on parts of the black matrix 3 extending between the long sides of the adjacent apertures 4. Preferably, the barriers 5 are formed of one of or one of combinations of metals of a metal group including nickel, cobalt, copper, iron, gold, silver, rhodium, palladium, platinum and zinc, one of alloys each of some of the metals of the metal group, or one of or one of combinations of some metal oxides of a metal oxide group including indium-tin oxide (ITO), indium-zinc oxide (IZO), tin oxide ($SnO_2$), antimony-doped tin oxide, indium- or antimony-doped titanium oxide ($TiO_2$), ruthenium oxide ($RuO_2$), and indium- or antimony-doped zirconium oxide ($ZrO_2$).

The barriers 5 have a height in the range of 20 to 100 $\mu$m, a length equal to that of the long sides of the apertures 4 or in the range of the length of the long sides of the apertures 4 minus about 5 $\mu$m and the length of the long sides of the apertures 4 plus about 20 $\mu$m, and a width in the range of 10 to 50 $\mu$m. Although the barriers 5 in this embodiment have the shape of a rectangular solid having a small width, the shape of the barriers 5 is not limited thereto and may be formed in a polygonal shape, a shape having expanding opposite ends or the like in a plane parallel to the surface of the transparent substrate 2. The shape of the barriers 5 in a plane parallel to the surface of the transparent substrate 12 may be properly determined taking into consideration the shape of the apertures 4, particularly, the shape of parts of the black matrix 3 lying between the adjacent apertures 4.

The fluorescent layers 6 of the front plate 1 are red fluorescent layers 6R that emit red light, green fluorescent layers 6G that emit green light and blue fluorescent layers 6B that emit blue light. Usually, the fluorescent layers 6 are formed in the apertures 4 by photolithography. There are not any particular restrictions on the material of the fluorescent layers 6 and fluorescent materials conventionally used for forming the fluorescent layers of field-emission displays. More concretely, possible red fluorescent materials are, for example, $Y_2O_3$:Eu, $Y_2SiO_5$:Eu, $Y_3Al_5O_{12}$:Eu, $ScBO_3$:Eu, $Zn_3(PO_4O)_2$:Mn, $YBO_3$:Eu, (Y, Gd)$BO_3$:Eu, $GdBO_3$:Eu, $LuBO_3$:Eu, $Y_2O_2S$:Eu and $SnO_2$:Eu. Possible green fluorescent materials are, for example, $Zn_2SiO_4$:Mn, $BaAl_{12}O_{19}$:Mn, $YbO_3$:Tb, $BaMgAl_{14}O_{23}$:Mn, $LuBO_3$:Tb, $GbBO_3$:Tb, $ScBO_3$:Tb, $Sr_6Si_3O_3Cl_4$:Eu, $ZnBaO_4$:Mn, ZnS:Cu, Al, ZnO:Zn, $Gd_2O_2S$:Tb, $ZnGa_2O_4$:Mn, ZnS:Cu, Au and Al. Possible blue fluorescent materials are, for example, $Y_2SiO_5$:Ce, $CaWO_4$:Pb, $BaMgAl_{14}O_{23}$:Eu, ZnS:Ag, ZnMgO, $ZnGaO_4$ and ZnS:Ag.

The front plate 1, differing from the conventional front plate, does not need a pattern of anodes and hence can be easily fabricated. The conductive matrix 3 and the plurality of barriers 5 are equipotential (anode potential). In the field-emission display employing the front plate 1 of the present invention, electron beams emitted by the electron-emitting elements (emitter electrodes) triggered by the gate electrodes of the back plate strike the fluorescent layers 6 formed in the corresponding apertures 4 formed in the black matrix 3 to make the fluorescent layers 6 emit light for displaying images. The barriers 5 absorb emitted secondary electrons and scattered electrons of the electron beams emitted by the electron-emitting elements (emitter electrodes) to prevent the secondary electrons and scattered electrons from flying, and charges accumulated in the barriers 5 by the absorption of the electrons are dissipated through the black matrix 3. Thus, the accumulation of charges on the barriers 5 is prevented. The barriers 5 do not emit gases while the field-emission display employing the front plate of the present invention is in operation. The present invention regards a front plate provided with only fluorescent layers as a front plate for a field-emission display.

In some cases, the transparent substrate of the front plate of the present invention for a field-emission display cracks due to thermal strain induced therein by difference in coefficient of thermal expansion between the transparent substrate and the barriers. To prevent the cracking of the transparent substrate, the black matrix may be formed of a material capable of preventing the induction of thermal stress or absorbing thermal stress or a conductive intermediate layer of a material capable of preventing the induction of thermal stress or of absorbing thermal stress may be interposed between the black matrix and the barriers.

Figure 2:
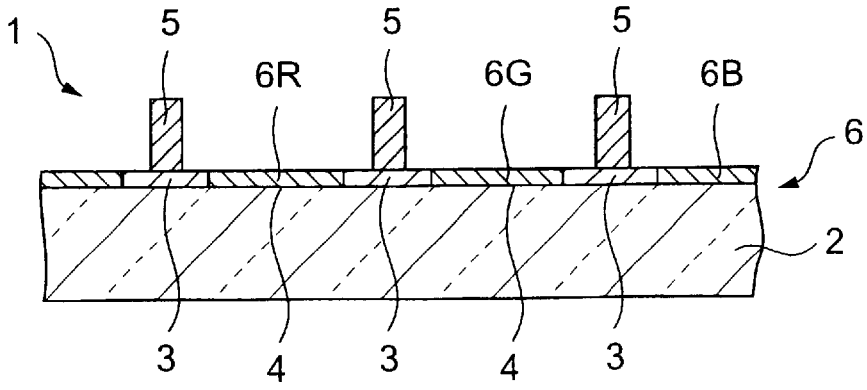
FIG. 2 is a sectional view taken on line A—A in FIG. 1.
Figure 3:
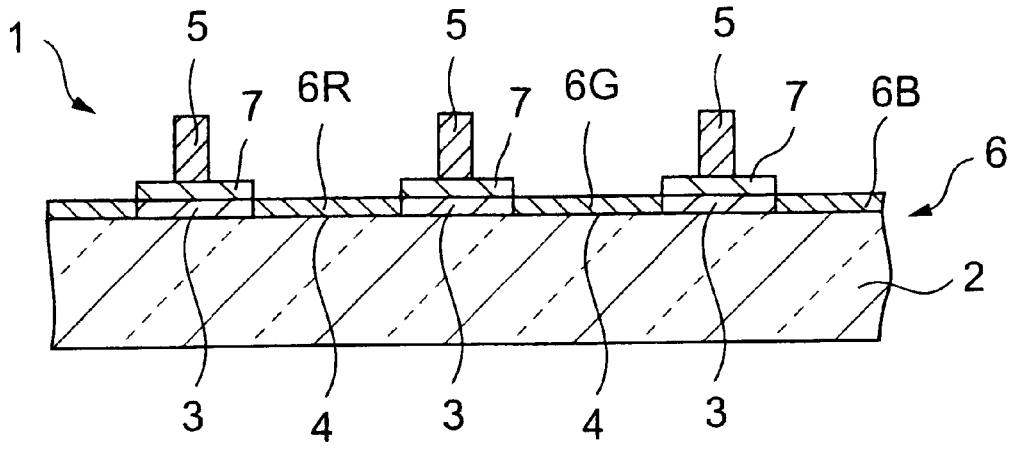
FIG. 3 is a fragmentary sectional view of a front plate in a first modification of the front plate shown in FIGS. 1 and 2.

Referring to FIG. 3 showing a front plate 1 in a first modification of the front plate 1 in the first embodiment shown in FIGS. 1 and 2, the front plate 1 has, in addition to components corresponding to those of the front plate 1 shown in FIG. 2, an intermediate layer 7 having parts formed between the black matrix 3 and the barriers 5. The intermediate layer 7 has a middle thermal or strength characteristic between those of the transparent substrate 2 and the barriers 5. For example, the intermediate layer 7 may be formed of a material having a substantially middle coefficient of thermal expansion between those of the materials forming the transparent substrate 2 and the barriers 5, an elongation percentage greater than that of the material forming the barriers 5 and a Young's modulus smaller than that of the material forming the barriers 5. If the barriers 5 are formed of nickel, a preferable material for forming the intermediate layer 7 is gold, silver, copper or the like. The parts of the intermediate layer 7 may be formed in a shape and dimensions exactly corresponding to those of parts of the black matrix 3 extending between the adjacent fluorescent layers 6 as shown in FIG. 3, in a shape and dimensions exactly corresponding to those of the bottom surfaces of the barriers 5 or in dimensions between those of the parts of the black matrix 3 extending between the adjacent fluorescent layers 6, and the bottom surfaces of the barriers 5. The parts of the intermediate layer 7 may be formed by patterning a single-layer film of one or some of the aforesaid materials or a multilayer film of some of the aforesaid materials. When the parts of the intermediate layer 7 are formed by patterning a multilayer film, the dimensions of the upper layer may be the same as or smaller than those of the lower layer of each part of the intermediate layer 7. The thickness of the intermediate layer 7 is determined selectively taking into consideration the properties of a material to be used and the characteristics of the transparent substrate 2 and the barriers 5 so that the intermediate layer 7 is able to prevent the induction of thermal stress in the transparent substrate 2 and the barriers 5 satisfactorily. The thickness of the intermediate layer 7 is, for example, in the range of about 1 to about 5 $\mu$m.

When the barriers 5 are formed by an electroplating process, the intermediate layer 7 prevents the oxidation of the surface of the black matrix 3 and improves the conductivity of the black matrix 3. A resist film for covering the black matrix 3 when forming the barriers 5 by an electroplating process and a conductive film forming the barriers 5 are able to adhere firmly to the intermediate layer 7. For example, when the film forming the black matrix 3 consists of a lower layer of chromium oxide and an upper layer of chromium, and the film for forming the barriers 5 is a nickel film, the resist film and the nickel film are unable to adhere firmly to the upper layer of chromium of the film forming the black matrix 3. Such a problem can be solved by forming a two-layer structure of a lower film of nickel and an upper film of gold by a vacuum evaporation process or a sputtering process as the intermediate layer 7 over the black matrix 3 of chromium. The intermediate layer 7 prevents the induction of thermal stress in the transparent substrate 2 and the barriers 5 and improves the conductivity of the black matrix 3 serving as a cathode for electroplating.

A method of preventing the cracking of the transparent substrate 2 forms the barriers 5 of a material having a coefficient of thermal expansion nearly equal to that of the transparent substrate 2. The barriers 5 are formed of an alloy having a comparatively small coefficient of thermal expansion or a conductive inorganic material containing particles of a material having a coefficient of thermal expansion smaller than that of the conductive inorganic material to prevent the induction of thermal stress in the transparent substrate 2 and the barriers 5. The barriers 5 of the conductive inorganic material containing such particles can be formed by a dispersion plating process using a plating bath prepared by dispersing particles of a metal or an inorganic substance having a small coefficient of thermal expansion or particles of a heat-resistant organic substance in a parent phase of a conductive inorganic material. For example, when the parent phase is nickel, a preferable disperse phase is iron, $SiO_2$, SiN or polytetrafluoroethylene generally known as Teflon. The particle content of the barriers 5 may be determined taking into consideration the coefficient of thermal expansion, conductivity and such of the disperse phase contained in the plating bath. The upper limit particle content of the barriers 5 is on the order of 20% by weight.

Figure 4:
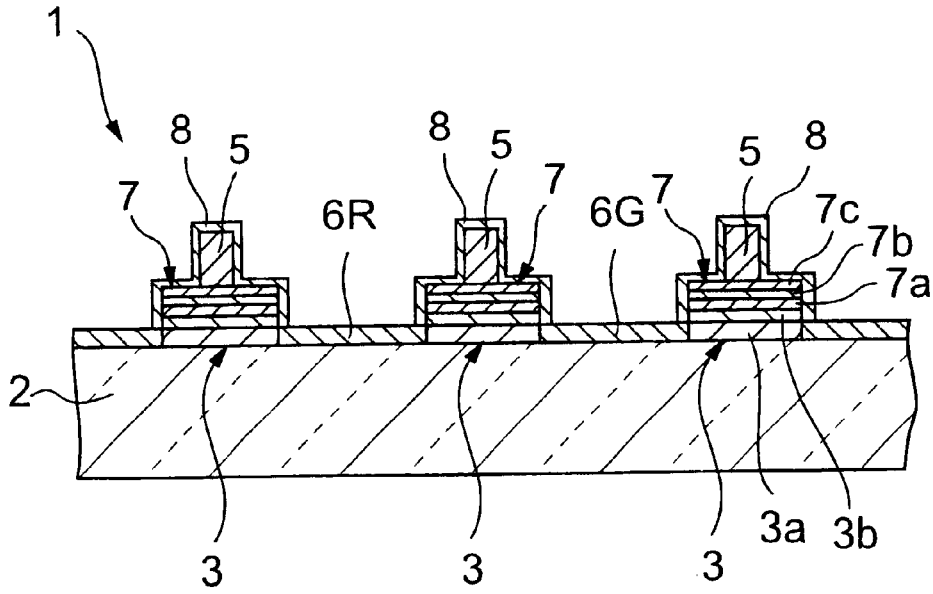
FIG. 4 is a fragmentary sectional view of a front plate in a second modification of a front plate shown in FIGS. 1 and 2.

Some materials forming the barriers 5 and the intermediate layer 7 diffuse into the black matrix 3 during a thermal process for forming the fluorescent layers 6 to cause the discoloration and fading of the black matrix 3 and the discoloration of the fluorescent layers 6. FIG. 4 shows a front plate 1 in a second modification of the front plate 1 in the first embodiment. In this front plate, a black matrix 3, barriers 5 and an intermediate layer 7 are covered with a metal thin film 8 as shown in FIG. 4. The black matrix 3 is a two-layer structure consisting of a chromium oxide film 3*a* and a chromium film 3*b*. The intermediate layer 7 is a three-layer structure consisting of a nickel thin film 7*a*, a gold thin film 7*b* and a silver thin film 7*c* formed in that order on the black matrix 3. The black matrix 3, the barriers 5 and the intermediate layer 7 may be covered entirely with a plated nickel film 8 to prevent the diffusion of the silver thin film 7*c*.

Second Embodiment

Figure 5:
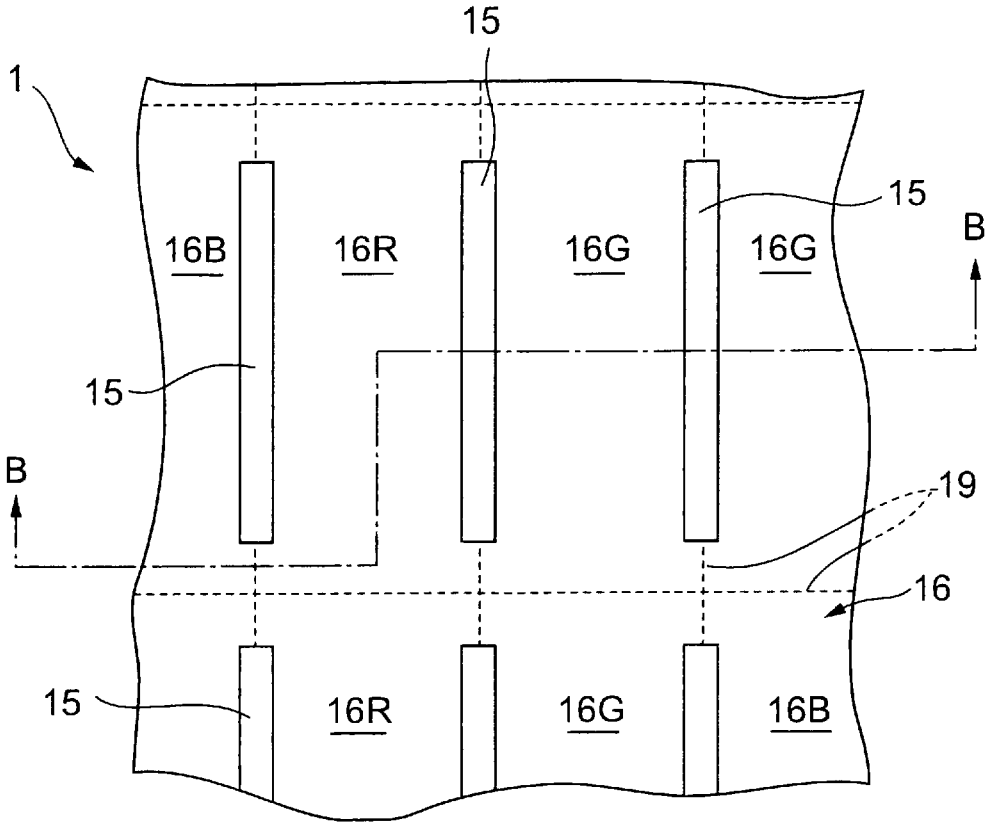
FIG. 5 is a fragmentary plan view of a front plate in a second embodiment according to the present invention for a field-emission display.
Figure 6:
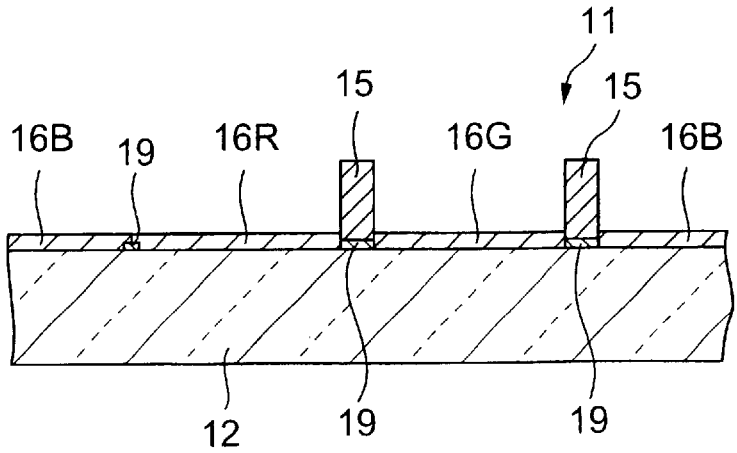
FIG. 6 is a sectional view taken on line B—B in FIG. 5.

A front plate 11 in a second embodiment according to the present invention for a field-emission display will be described with reference to FIGS. 5 and 6. Referring to FIGS. 5 and 6, the front plate 11 has a transparent substrate 12, a plurality of barriers 15 formed on predetermined parts of the transparent substrate 12, and fluorescent layers 16 formed on parts of the transparent substrate other than those of the same on which the barriers 15 are formed. The barriers 15 are electrically connected by charge dissipating lines 19 formed on the transparent substrate 12. The transparent substrate 12 of the front plate 11 is similar to the transparent substrate 2 of the front plate 1 and hence the description thereof will be omitted.

The barriers 15 of the front plate 11 have the shape of a rectangular solid of a narrow width. The barriers 15 are arranged longitudinally and laterally in parallel to each other at predetermined intervals. The barriers 15 are formed of a conductive inorganic material by an electroless plating process or an electroplating process using desired parts of the charge dissipating lines 19 as electrodes. Possible conductive inorganic materials for forming the barriers 15 are the same as those for forming the barriers 5 of the front plate in the first embodiment. The height of the barriers 5 is in the range of 20 to 100 $\mu$m, and the length of the same is dependent on the length of the electron-emitting elements (emitter electrodes) formed between the gate electrodes of a back plate and is in the range of 200 to 280 $\mu$m. The width of the barriers 15 is in the range of 10 to 50 $\mu$m. Although the barriers 15 of the front plate shown in FIGS. 5 and 6, have the shape of a rectangular solid of a small width, the shape of the barriers 15 is not limited thereto and may be formed in a shape having a section, in a plane parallel to the surface of the transparent substrate 12, of a polygonal shape, a shape having expanding opposite ends or the like.

The fluorescent layers 16 of the front plate 11 include red fluorescent layers 16R, green fluorescent layers 16B and blue fluorescent layers 16B arranged in a predetermined arrangement. The fluorescent layers 16 are formed by photolithography. Fluorescent materials forming the fluorescent layers 16 are the same as those for forming the fluorescent materials for forming the fluorescent layers 6 of the front plate 1 in the first embodiment.

The charge dissipating lines 19 connect the barriers 15 electrically. The charge dissipating lines 19 are formed on boundaries between the adjacent cells (the red fluorescent layers 16R, the green fluorescent layers 16G and the blue fluorescent layers 16B) so as to be at least partly in contact with the barriers 15. In this embodiment, the charge dissipating lines 19 have two-dimensional parts underlying the barriers 15 and having the same shape as that of the barriers 15 in a plane parallel to the surface of the transparent substrate 12, and linear parts extending between the barriers 15. The charge dissipating lines 19 are formed by forming a thin film of the same material as that forming the barriers 15 on the transparent substrate 12 by a thin film forming process, such as a vacuum evaporation process or a sputtering process, forming a mask of a pattern corresponding to that of the charge dissipating lines 19, and etching the thin film through the mask. The charge dissipating lines 19 may be formed by printing a conductive ink containing a conductive inorganic material by screen printing or the like in a pattern corresponding to the charge dissipating lines 19 and removing the organic components of the conductive ink from the printed pattern by baking.

The front plate 11 does not have any pattern for anodes, which are necessary for the conventional front plate. Therefore, the front plate 11 can be easily fabricated. All the barriers 15 of the front plate 11 are connected electrically by the charge dissipating lines 19 and are equipotential (anode potential). In the field-emission display employing the front plate 11 of the present invention, electron beams emitted by the electron-emitting elements (emitter electrodes) triggered by the gate electrodes of the back plate strike the cells of the fluorescent layers 16 to make the corresponding fluorescent layers 16 emit light to display images. The barriers 15 absorb emitted secondary electrons and scattered electrons of the electron beams emitted by the electron-emitting elements (emitter electrodes) to prevent the secondary electrons and scattered electrons from flying, and charges accumulated in the barriers 15 by the absorption of the electrons are dissipated through the charge dissipating lines 19. Thus, the accumulation of charges on the barriers 15 is prevented. The barriers 15 do not emit gases while the field-emission display employing the front plate 11 of the present invention is in operation. The present invention regards a front plate provided with only fluorescent layers as a front plate for a field-emission display.

Figure 7:
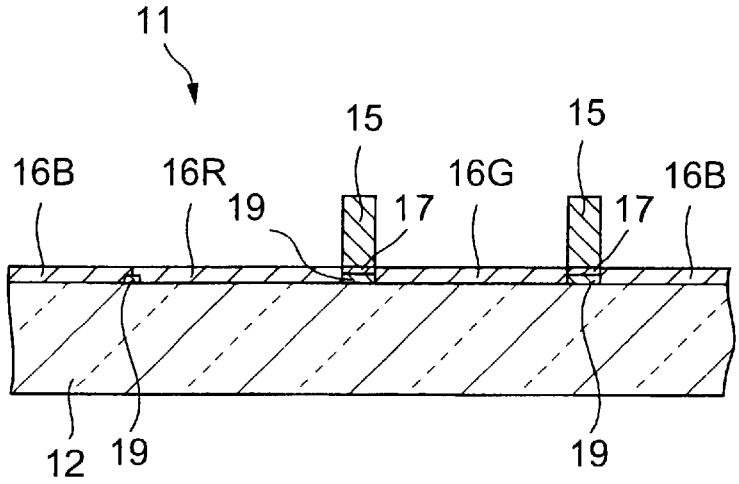
FIG. 7 is a fragmentary sectional view of a front plate in a modification of the front plate shown in FIGS. 5 and 6.

The front plate 11, similarly to the front plate 1, may be provided with an intermediate layer 17 of a material capable of preventing or absorbing thermal stress induced in the transparent substrate 12 between the barriers 15 and the transparent substrate 12 as shown in FIG. 7 to prevent the cracking of the transparent substrate 12. As shown in FIG. 7, parts of the intermediate layer 17 are formed between the transparent substrate 12 and the barriers 15. The intermediate layer 17, similarly to the intermediate layer 7, may be formed of a material having, for example, a substantially middle coefficient of thermal expansion between those of the materials forming the transparent substrate 12 and the barriers 15, an elongation percentage greater than that of the material forming the barriers 15 and a Young's modulus smaller than that of the material forming the barriers 15. The parts of the intermediate layer 17 may be formed in a shape and dimensions exactly corresponding to or greater than those of the bottom surfaces of the barriers 15. The intermediate layer 17 may be formed integrally with the charge dissipating lines 19. The intermediate layer 17 is similar to the aforesaid intermediate layer 7 in construction and thickness.

The barriers 15 are formed of an alloy having a comparatively small coefficient of thermal expansion or a material containing particles of a material having a coefficient of thermal expansion smaller than that of the conductive inorganic material to prevent the cracking of the transparent substrate 12 due to the induction of thermal stress in the transparent substrate 12 and the barriers 15. The barriers 15 are the same as the aforesaid barriers 5 in material of the particles and particle content.

Some materials forming the barriers 15 and the intermediate layer 17 diffuse into the fluorescent layers 16 during a thermal process for forming the fluorescent layers 16 to cause the discoloration and fading of the fluorescent layers 16. The barriers 15 and the intermediate layer 17 may be covered with a metal thin film to prevent the discoloration and fading of the fluorescent layers 16. If the intermediate layer 17 shown in FIG. 7 is a silver thin film, the barriers 15 and the intermediate layer 17 may be covered entirely with a plated nickel film capable of preventing the diffusion of the silver thin film.

Third Embodiment

Figure 8:
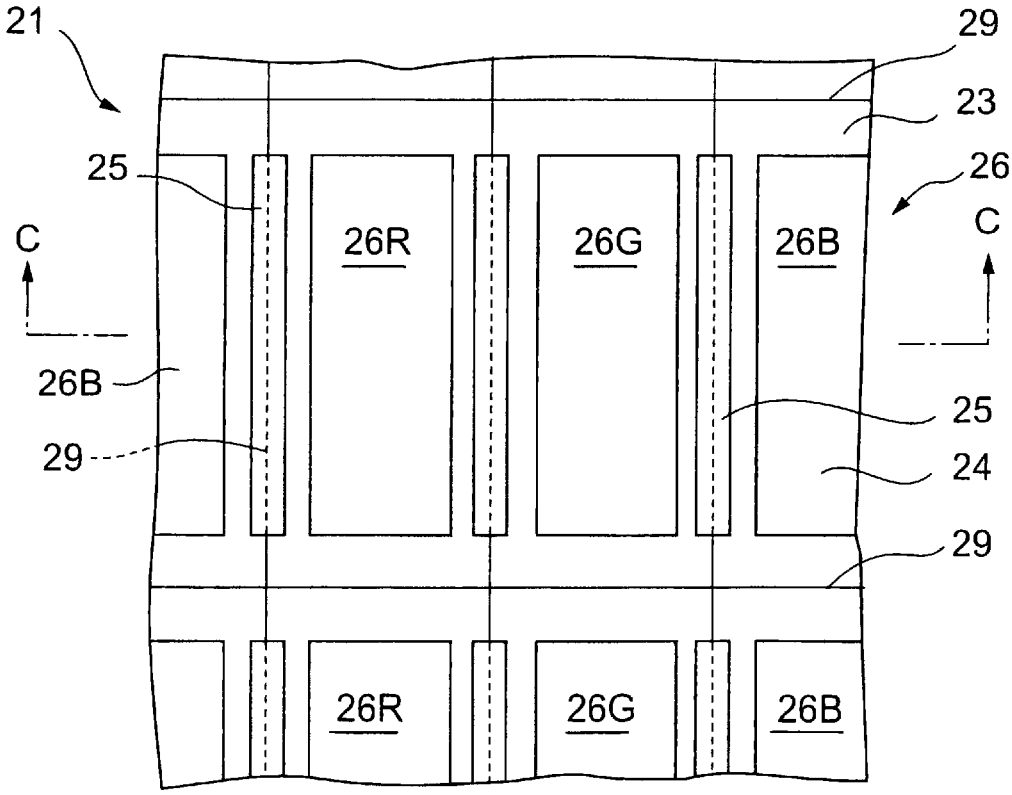
FIG. 8 is a fragmentary plan view of a front plate in a third embodiment according to the present invention for a field-emission display.
Figure 9:
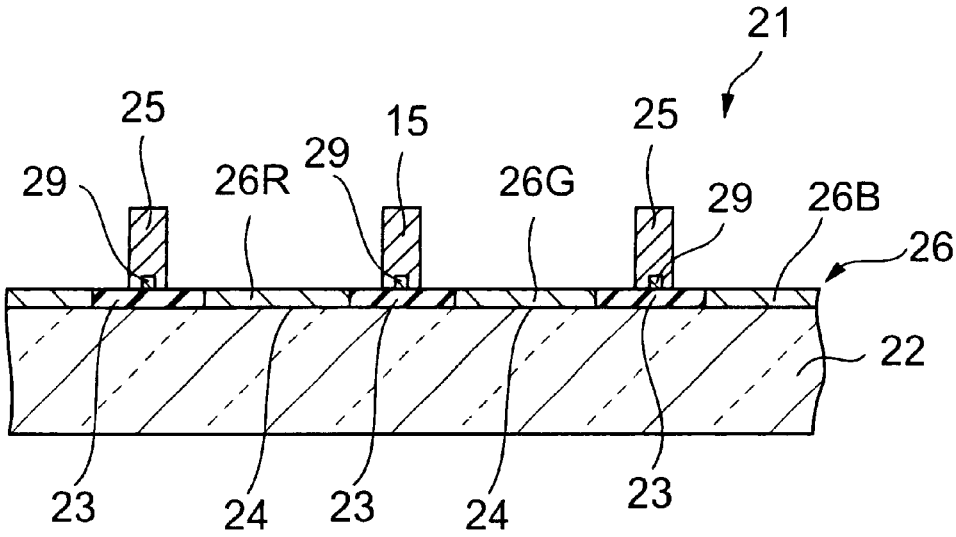
FIG. 9 is a sectional view taken on line C—C in FIG. 8.

A front plate 21 in a third embodiment according to the present invention for a field-emission display will be described with reference to FIGS. 8 and 9. Referring to FIGS. 8 and 9, the front plate 21 has a transparent substrate 22, a black matrix 23 formed on one of the surfaces of the transparent substrate 22, a plurality of barriers 25 formed on predetermined parts of the black matrix 23 and fluorescent layers 26 formed in a plurality of apertures 24 formed in the black matrix 23. The barriers 25 are electrically connected by charge dissipating lines 29 formed on the black matrix 23. The transparent substrate 22 of the front plate 21 is similar to the transparent substrate 2 of the front plate 1 and hence the description thereof will be omitted.

The black matrix 23 of the front plate 21 is a black film having a low reflectivity to enhance the contrast of images displayed on the field-emission display. In the third embodiment, the black matrix 23 is an electrical insulating film or a conductive film incapable of satisfactorily electrically connecting the barriers 25. The black matrix 23 is formed by forming a film of a photosensitive black paste containing a black pigment and glass frit or a photosensitive, conductive, black paste containing a black pigment, conductive particles of silver or the like and glass frit, patterning the film to form the apertures 24 by subjecting the film to exposure and development processes, and baking the patterned film to remove organic components. The thickness of the black matrix 23 may be in the range of 1 to 10 $\mu$m. The apertures 24 may be the same as the apertures 4 of the front plate 1 in size, pitches and shape.

The barriers 25 of the front plate 21 have the shape of a rectangular solid having a small width. The barriers 25 are extended longitudinally and laterally in parallel to each other at predetermined intervals. A conductive inorganic material forming the barriers 25 may be the same as that forming the barriers 5 of the aforesaid front plate 1. The height, length and width of the barriers 25 may be similar to those of the barriers 5 of the aforesaid front plate 1. The barriers 5 have a height in the range of 20 to 100 $\mu$m, a length equal to that of the long sides of the apertures 4 or in the range of the length of the long sides of the apertures 4 minus about 5 $\mu$m and the length of the long sides of the apertures 4 plus about 20 $\mu$m, and a width in the range of 10 to 50 $\mu$m. Although the barriers 25 in this embodiment have the shape of a rectangular solid having a small width, the shape of the barriers 25 is not limited thereto and may be formed in a polygonal shape, a shape having expanding opposite ends or the like in a plane parallel to the surface of the transparent substrate 22. The shape of the barriers 5 in a plane parallel to the surface of the transparent substrate 22 may be properly determined.

The fluorescent layers 26 of the front plate 21 are red fluorescent layers 26R that emit red light, green fluorescent layers 26G that emit green light and blue fluorescent layers 26B that emit blue light. Usually, the fluorescent layers 26 are formed in the apertures 24 by photolithography. The fluorescent layers 26 may be formed of fluorescent materials generally used for conventional field-emission displays, such as those mentioned previously in connection with the description of the fluorescent layers 6 of the front plate 1 in the first embodiment.

The charge dissipating lines 29 connect the barriers 25 electrically. The charge dissipating lines 29 are formed in a predetermined pattern on the black matrix 23. The charge dissipating lines 29 have linear parts formed on parts of the black matrix 25 not provided with the barriers 25 so as to be in contact at least partly with the barriers 25. In the third embodiment, the linear parts of the charge dissipating lines 29 are arranged in a grid. The charge dissipating lines 29 are formed by forming a film of a conductive inorganic material, which is the same as that forming the barriers 25, on the black matrix 23 by a thin film forming process, such as a vacuum evaporation process or a sputtering process, forming a mask of a pattern corresponding to that of the charge dissipating lines 29, and etching the thin film through the mask. The charge dissipating lines 29 may be formed by printing a pattern corresponding to the charge dissipating lines 29 with a conductive ink containing a conductive inorganic material and removing organic components of the conductive ink from the printed pattern by baking.

The front plate 21 does not have any pattern for anodes, which are necessary for the conventional front plate. Therefore, the front plate 21 can be easily fabricated. All the barriers 25 of the front plate 21 are connected electrically by the charge dissipating lines 29 and are equipotential (anode potential). In the field-emission display employing the front plate 21 of the present invention, electron beams emitted by the electron-emitting elements (emitter electrodes) triggered by the gate electrodes of the back plate strike the cells of the fluorescent layers 26 to make the corresponding fluorescent layers 26 emit light to display images. The barriers 25 absorb emitted secondary electrons and scattered electrons of the electron beams emitted by the electron-emitting elements (emitter electrodes) to prevent the secondary electrons and scattered electrons from flying, and charges accumulated in the barriers 25 by the absorption of the electrons are dissipated through the charge dissipating lines 29. Thus, the accumulation of charges on the barriers 25 is prevented. The barriers 25 do not emit gases while the field-emission display employing the front plate 21 of the present invention is in operation. The present invention regards a front plate provided with only fluorescent layers as a front plate for a field-emission display.

The front plate 21, similarly to the front plate 1, may be formed of a material capable of absorbing a thermal stress induced in the black matrix 23 to prevent the cracking of the transparent plate 22 due to difference in coefficient of thermal expansion between the transparent substrate 22 and the barriers 25.

Figure 10:
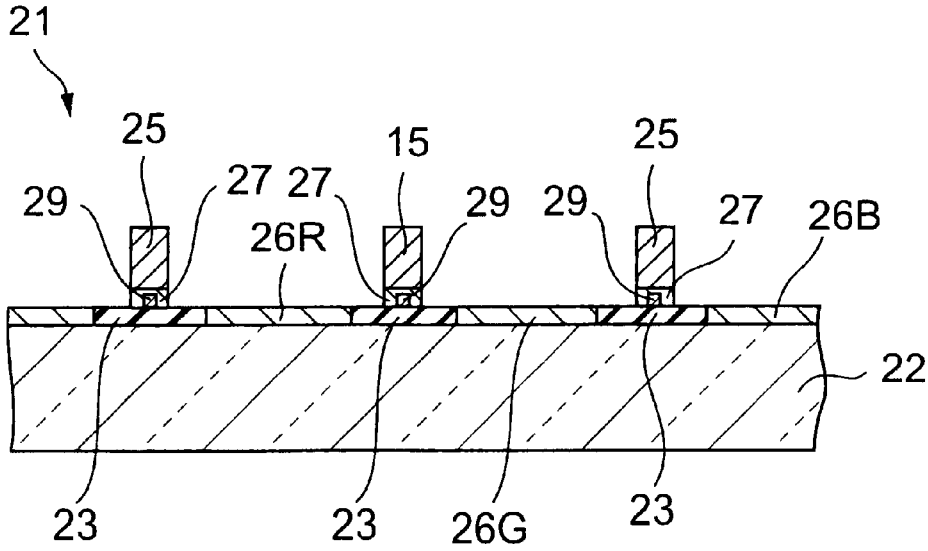
FIG. 10 is a fragmentary sectional view of a front plate in a modification of the front plate shown in FIGS. 8 and 9.

An intermediate layer of a conductive material capable of preventing or absorbing thermal stress may be formed between the black matrix 23 and the barriers 25. FIG. 10 shows a front plate 21 provided with an intermediate layer in a modification of the front plate 21 shown in FIGS. 8 and 9. As shown in FIG. 10, parts of an intermediate layer 27 are formed between a black matrix 23 (charge dissipating lines 29) and barriers 25. The intermediate layer 27, similarly to the intermediate layer 7, may be formed of a material having, for example, a substantially middle coefficient of thermal expansion between those of the materials forming the transparent substrate 22 and the barriers 25, an elongation percentage greater than that of the material forming the barriers 25 and a Young's modulus smaller than that of the material forming the barriers 25. The parts of the intermediate layer 27 may be formed in a shape and dimensions exactly corresponding to those of the bottom surfaces of the barriers 25, a shape and dimensions exactly corresponding to the parts of the black matrix 23, i.e., in the same pattern as that of the black matrix, or in a size between those of the bottom surfaces of the barriers 25 and the parts of the black matrix 23. The intermediate layer 27 may be formed by forming a thin film of the aforesaid desired material on the black matrix 23 by a vacuum evaporation process or a sputtering process, forming a mask of a pattern of the intermediate layer 27, and patterning the thin film by an etching process using the mask. The intermediate layer 27 may be formed by an electroless plating process. The intermediate layer 27 may be formed integrally with the charge dissipating lines 29. The intermediate layer 27 is similar to the aforesaid intermediate layer 7 in construction and thickness.

The barriers 25 may be formed of an alloy having a comparatively small coefficient of thermal expansion or a material containing particles of a material having a coefficient of thermal expansion smaller than that of the conductive inorganic material forming the barriers 25 to prevent the cracking of the transparent substrate 22 due to the induction of thermal stress in the transparent substrate 22 and the barriers 25. The barriers 15 are the same as the aforesaid barriers 5 in material of the particles and particle content.

Some materials forming the barriers 25 and the intermediate layer 27 diffuse into the black matrix 23 during a thermal process for forming the fluorescent layers 26 to cause the discoloration and fading of the black matrix 23 and the fluorescent layers 26. The black matrix 23, the barriers 25 and the intermediate layer 27 may be covered with a metal thin film to prevent the discoloration and fading of the black matrix 23 and the fluorescent layers 26. If the intermediate layer 27 shown in FIG. 10 is a silver thin film, the black matrix 23, the barriers 25 and the intermediate layer 27 may be covered entirely with a plated nickel film capable of preventing the diffusion of the silver thin film.

Methods of Fabricating Front Plate

Methods of fabricating the aforesaid front plates embodying the present invention for field-emission displays will be described.

First, a method of fabricating the front plate 1 shown in FIGS. 1 and 2 will be described with reference to FIGS. 11 and 12.

Figure 11A:
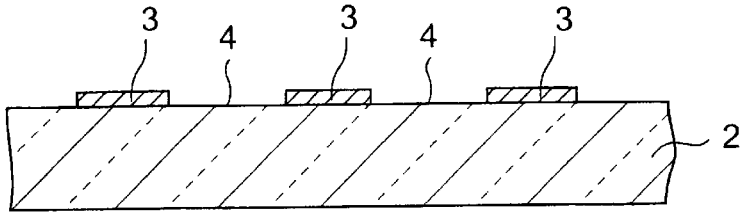
FIGS. 11(A) to 11(D) are fragmentary sectional views of assistance in explaining a first method of fabricating the front plate in the first embodiment according to the present invention for a field-emission display.

A thin film for forming the black matrix 3 is formed on the transparent substrate 2 by a thin film forming process, such as a vacuum evaporation process or a sputtering process, a photoresist film is formed on the thin film, the photoresist film is exposed and developed to form a mask of a desired pattern, the thin film is etched through the mask in a desired pattern, and then the mask is removed to complete the black matrix 3 provided with the apertures 4 as shown in FIG. 11(A).

Figure 11B:
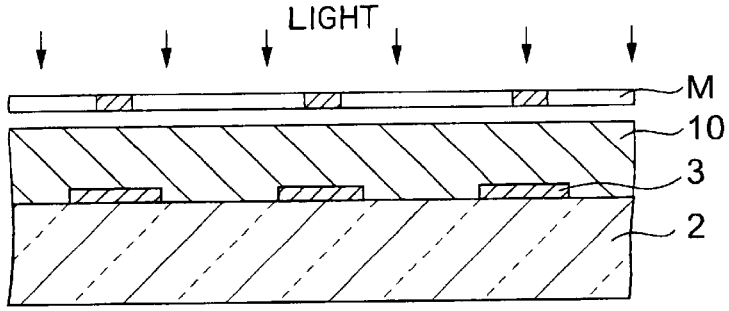
Figure 11C:
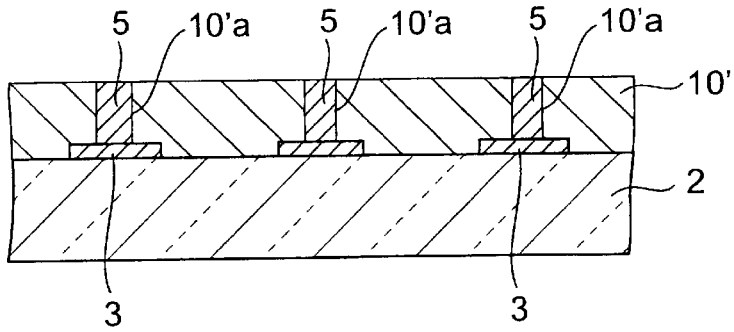
Figure 11D:
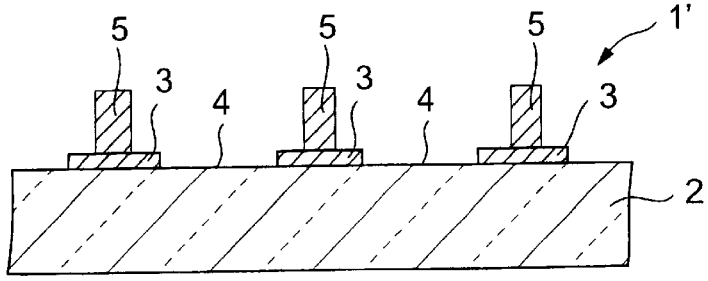

Subsequently, a photoresist film 10 is formed on the transparent substrate 2 so as to cover the black matrix 3 entirely, and the photoresist film 10 is exposed to light through a mask M provided with a plurality of openings corresponding to the barriers 5 as shown in FIG. 11(B). The photoresist film 10 may be formed by applying a photoresist to the transparent substrate 2 or by laminating a dry resist film to the transparent substrate 2. The thickness of the photoresist film 10 is equal to or greater than the height of the barriers 5. The exposed photoresist film 10 is developed to form a resist mask 10' provided with a plurality of slots 10'*a* to expose desired parts of the surface of the black matrix 3. A conductive inorganic material is deposited in a desired height in the slots 10'*a* by an electroplating process to form the barriers 5 as shown in FIG. 11(C). Then, the resist mask 10' is removed to complete a front plate 1' provided with the barriers 5 on the black matrix 3 as shown in FIG. 11(D).

When the intermediate layer 7 is formed between the black matrix 3 and the barriers 5 as shown in FIG. 3, the intermediate layer 7 is formed by an electroplating process and then the barriers 5 are formed on the intermediate layer 7. The barriers 5 containing the particles to prevent the cracking of the transparent substrate 2 are formed by a dispersion plating process using a plating bath prepared by mixing a disperse phase of a desired material and a parent phase. The metal thin film 8 entirely covering the black matrix 3, the barriers 5 and the intermediate layer 7 can be formed by an electroplating process, or a vacuum evaporation process or a sputtering process using a predetermined mask.

Figure 12A:
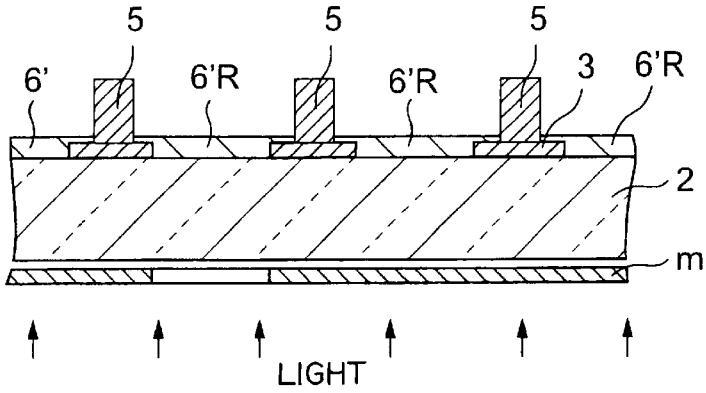
FIGS. 12(A) to 12(C) are fragmentary sectional views of assistance in explaining the first method of fabricating the front plate in the first embodiment.
Figure 12B:
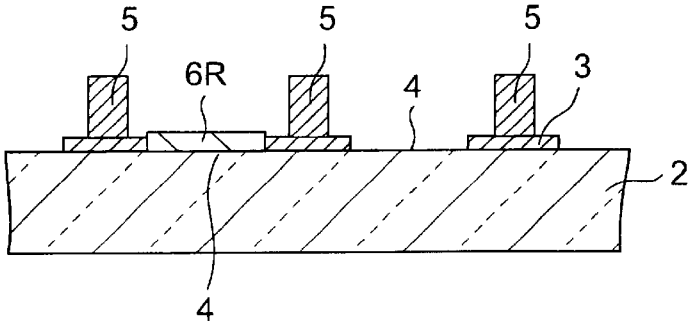
Figure 12C:
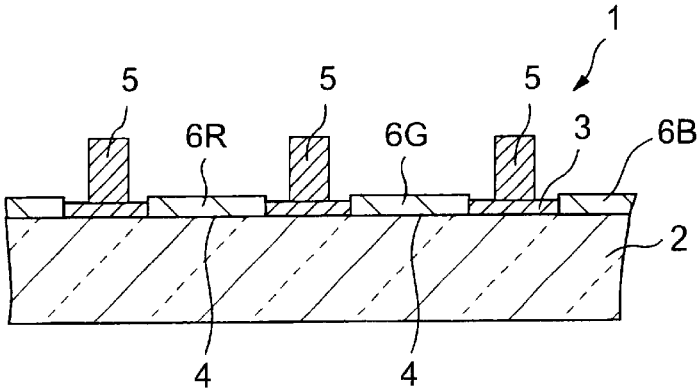

Subsequently, the front surface of the transparent substrate 2, i.e., the surface provided with the black matrix 3 and the barriers 5, is coated with a red fluorescent coating film 6'R for forming the red fluorescent layers 6R, and the red fluorescent coating film 6'R is exposed through a mask m provided with a predetermined pattern of openings to light projected thereon through the back surface of the transparent substrate 2 as shown in FIG. 12(A). Then, the exposed red fluorescent coating film 6'R is developed and the developed red fluorescent coating film 6'R is heated by a heating process to form the red fluorescent layers 6R in the predetermined apertures 4 of the black matrix 3 as shown in FIG. 12(B). The foregoing processes are repeated to form the green fluorescent layers 6G and the blue fluorescent layers 6B. Thus the front plate 1 as shown in FIG. 12(C) is completed. All the developed fluorescent coatings for forming the fluorescent layers 6R, 6G and 6B may be simultaneously subjected to the heating process.

A method of fabricating the front plate 21 in the third embodiment shown in FIGS. 8 and 9 will be described with reference to FIG. 13.

Figure 13A:
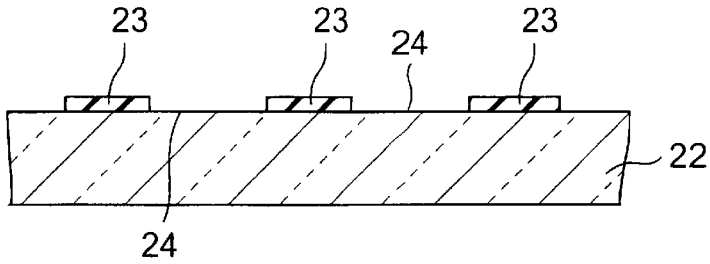
FIGS. 13(A) to 13(E) are fragmentary sectional views of assistance in explaining a second method of fabricating the front plate in the third embodiment according to the present invention for a field-emission display.

A thin film of a photosensitive black paste containing a black pigment and glass frit or a conductive photosensitive black paste containing a black pigment, conductive particles, such as silver particles, and glass frit is formed on the transparent substrate 22. The thin film is exposed to light through a mask for forming the black matrix 23, the exposed thin film is developed, the developed thin film is baked to remove the organic components to form the black matrix 23 provided with the apertures 24 as shown in FIG. 13(A).

Figure 13B:
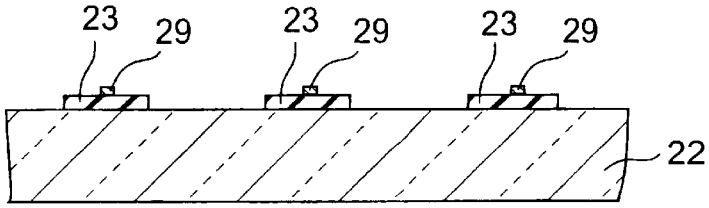

Then, the charge dissipating lines 29 having linear parts are formed on the black matrix 23 as shown in FIG. 13(B). The charge dissipating lines 29 are formed by forming a thin film of a conductive inorganic material on the black matrix 23 by a thin film forming process, such as a vacuum evaporation process or a sputtering process, forming a mask of a desired pattern on the thin film, and etching the thin film through the mask. The charge dissipating lines 29 may be formed by printing a conductive ink containing a conductive inorganic material by screen printing or the like in a pattern corresponding to the charge dissipating lines 29 and removing the organic components of the conductive ink from the printed pattern by baking.

Figure 13C:
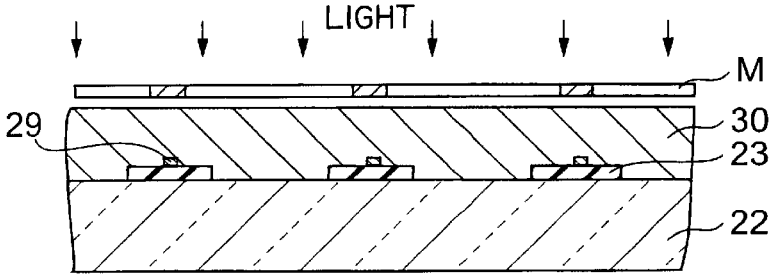
Figure 13D:
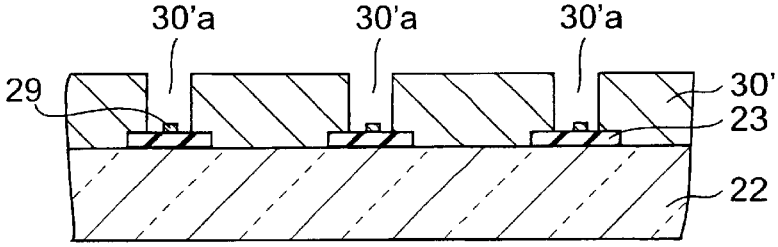

Subsequently, a photoresist film 30 is formed on the transparent substrate 22 so as to cover the charge dissipating lines 29 and the photoresist film 30 is exposed to light through a mask M provided with a plurality of openings corresponding to the barriers 25 as shown in FIG. 13(C). The photoresist film 30 may be formed by applying a photoresist to the transparent substrate 22 or by laminating a dry resist film to the transparent substrate 22. The photoresist film 30 is formed in a thickness equal to the height of the barriers 25. The exposed photoresist film 30 is developed to form a resist mask 30' provided with a plurality of slots 30'*a* through which desired parts of the surfaces of the black matrix 23 and the charge dissipating lines 29 are exposed. A catalyst for electroplating (a water-soluble salt, such as a chloride or a nitrate of palladium, gold, silver, platinum or copper or a complex compound) is applied to the surface of the resist mask 30 including the side surfaces of the slots 30'*a* as shown in FIG. 13(D).

Figure 13E:
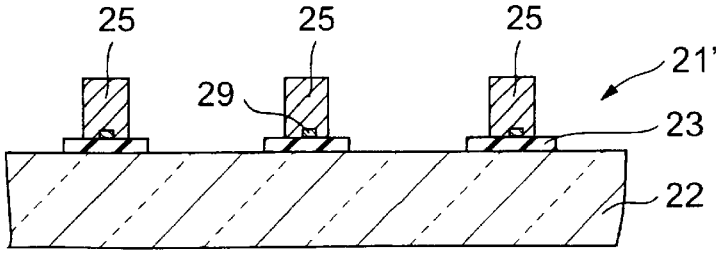

Then, the transparent substrate 22 is immersed in an electroless plating bath to deposit a metal film on the surfaces coated with the catalyst. Thus, the barriers 25 of a metal are deposited in the slots 30'*a*. Then, the resist mask 30' is removed to obtain a front plate 21' provided with the black matrix 23 and the barriers 25 formed on the black matrix 23 as shown in FIG. 13(E). All the exposed surfaces of the black matrix 23 and the barriers 25 can be coated with a metal thin film by subjecting the front plate 21' to an electroplating process or by a vacuum evaporation or sputtering process using a mask.

The red fluorescent layers 26R, the green fluorescent layers 26G and the blue fluorescent layers 26B are formed by the same processes as those explained in connection with the method of fabricating the front plate 1 to complete the front plate 21 in the third embodiment.

A method of fabricating the front plate 21 provided with the intermediate layer 27 formed integrally with the charge dissipating lines 29 will be described with reference to FIG. 14.

A thin film of a photosensitive black paste containing a black pigment and glass frit or a conductive, photosensitive black paste containing a black pigment, conductive particles, such as silver particles, and glass frit is formed on the transparent substrate 22. The thin film is exposed to light through a mask for forming the black matrix 23, the exposed thin film is developed, the developed thin film is baked to remove the organic components to form the black matrix 23 provided with the apertures 24 as shown in FIG. 14 (A).

Figure 14A:
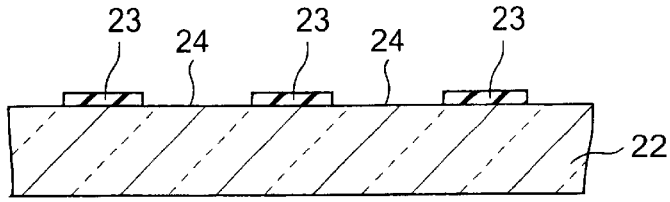
FIGS. 14(A) to 14(E) are fragmentary sectional views of assistance in explaining a method of fabricating the front plate shown in FIG. 10.
Figure 14B:
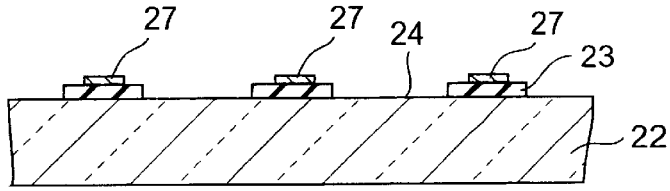

Then, a resist film provided with openings corresponding to the intermediate layers 27 and the charge dissipating lines 29 is formed on the black matrix 23. A conductive thin film is formed on the black matrix 23 by a vacuum evaporation or sputtering process by using the resist film as a mask and then the resist film is removed. Thus the intermediate layer 27 serving also as the charge dissipating lines 29 is formed on the black matrix 23 as shown in FIG. 14(B).

Figure 14C:
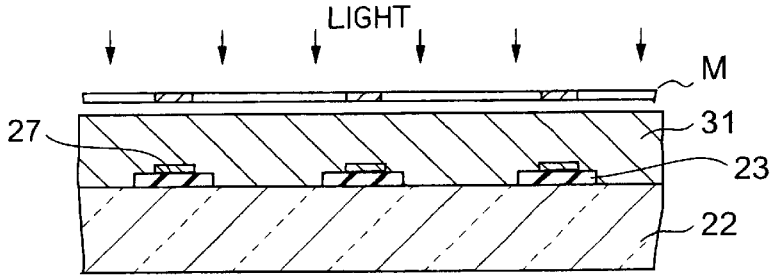
Figure 14D:
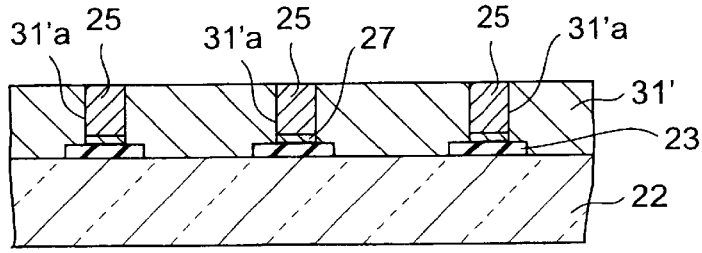
Figure 14E:
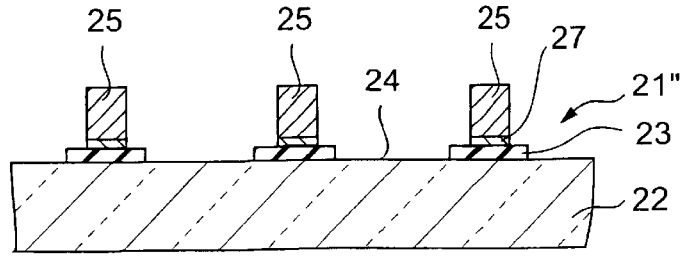

A photoresist film 31 is formed on the transparent substrate 22 so as to cover the black matrix 23, the intermediate layer 27 and the charge dissipating lines 29, and the photoresist film 31 is exposed to light through a mask M provided with a plurality of openings corresponding to the barriers 25 as shown in FIG. 14(C). The photoresist film 31 may be formed by applying a photoresist to the transparent substrate 22 or by laminating a dry resist film to the transparent substrate 22. The thickness of the photoresist film 31 is equal to or greater than the height of the barriers 25. Then, the exposed photoresist film 31 is developed to form a resist mask 31' provided with a plurality of slots 31'*a* through which the surfaces of desired parts of the intermediate layer 27 are exposed. A conductive inorganic material is deposited in a predetermined thickness in the slots 31'*a* by an electroplating by using the black matrix and the intermediate layer 27 as anodes to form the barriers 25 as shown in FIG. 14(D). Subsequently, the resist mask 31' is removed to obtain a front plate 21' provided with the barriers 25 formed on the intermediate layer 27 formed on the black matrix 23 as shown in FIG. 14(E).

The barriers 25 containing the particles to prevent the cracking of the transparent substrate 22 may be formed by a dispersion plating process using a plating bath prepared by mixing a disperse phase of a desired material and a parent phase. A metal thin film entirely covering the black matrix 23, the barriers 25, the intermediate layer 27 and the charge dissipating lines 29 can be formed on the front plate 21' by an electroplating process, or a vacuum evaporation process or a sputtering process using a predetermined mask.

The red fluorescent layers 26R, the green fluorescent layers 26G and the blue fluorescent layers 26B are formed by the same processes as those explained in connection with the method of fabricating the front plate 1 to complete the front plate 21 shown in FIG. 10.

Whereas the barriers of the conventional front plates are formed of a resin, such as a polyamide resin, the barriers 5 and 25 of the front plates 1 and 21 are formed of a conductive inorganic material. Therefore the methods of fabricating the front plates 1 and 21 do not need to form any conductive metal film and hence the same are simple. Since the processes for forming the fluorescent layers 6 and 26 are able to use high heating temperatures, luminance can be increased, durability can be enhanced owing to the reduction of discharged gases and reliability can be improved.

Field-Emission Display

Figure 15:
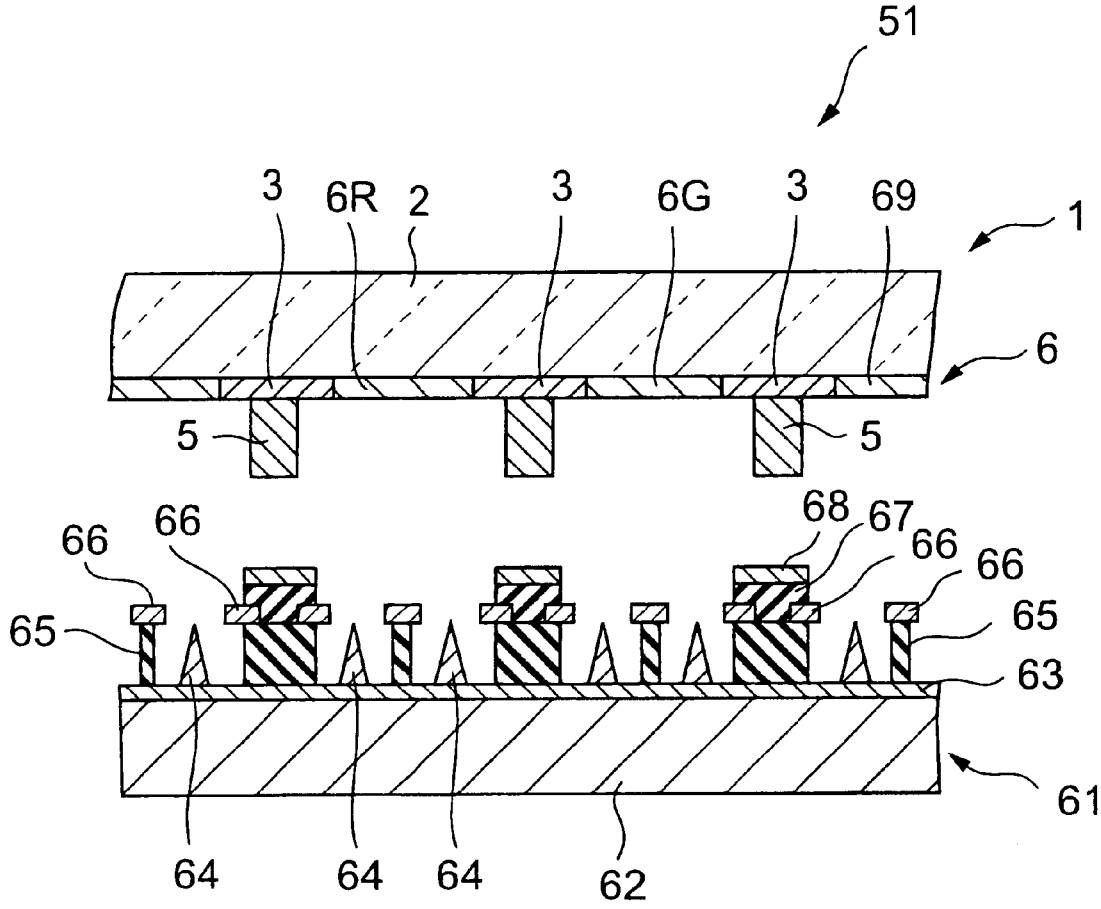
FIG. 15 is a fragmentary sectional view of a field-emission display panel employing a front plate according to the present invention.

A field-emission display employing the front plate of the present invention will be described. Referring to FIG. 15 showing a field-emission display 51 in a sectional view, the field-emission display 51 is formed by disposing a front plate (anode plate) 1 and a back plate (cathode plate) 61 opposite to each other with a spacer, not shown, of a predetermined thickness held between the front plate 1 and the back plate 61 to define a space of a predetermined thickness. The space defined by the front plate 1, the back plate 61 and the spacer is evacuated.

The front plate (anode plate) 1 has a transparent substrate 2, a black matrix 3 formed on one of the surfaces of the transparent substrate 2, and a plurality of barriers 5 formed in predetermined parts of the black matrix 3. The black matrix 3 is provided with a plurality of apertures 4. Fluorescent layers 6 are formed on parts of the transparent substrate 2 exposed in the apertures 4. The front plate 1 is not provided with any pattern of anodes, which is essential to the conventional front plate (anode plate).

The back plate (cathode plate) 61 has parallel emitter electrodes 63 formed on a transparent substrate 62, an insulating layer 65 formed on the emitter electrodes 63, gate electrodes (extraction electrodes) formed on the insulating layer 65 so as to extend perpendicularly to the emitter electrodes 63, and conical electron-emitting elements (emitter electrodes) 64 formed on the emitter electrodes 63. The electron-emitting elements (emitter electrodes) 64 correspond to the fluorescent layers 6 of the cells of the front plate (anode) 1, respectively. The gate electrodes (extraction electrodes) 66 correspond to the barriers 5 of the front plate (anode plate) 1, respectively. In the field-emission display shown in FIG. 5, the plurality of electron-emitting elements (emitter electrodes) 64 corresponds to each of the cells. The number of the electron-emitting elements (emitter electrodes) 64 for each cell may be selectively determined. An insulating layer 67 is formed on the gate electrodes 66 of the back plate 61, and focusing electrodes 68 are formed at positions on the insulating layer 67, respectively corresponding to the gate electrodes 61.

When displaying images by the field-emission display 51, a predetermined voltage is applied across the emitter electrodes 63 and the corresponding gate electrodes 66, electron beams emitted by the electron emitting elements (emitter electrodes) 64 are collimated by the focusing electrodes 68 in narrower electron beams by the focusing electrodes 68, the electron beams strike the fluorescent layers 6 of the desired colors to make the fluorescent layers 6 emit light. Secondary electrons and scattered electrons of the electron beams emitted by the electron emitting elements (emitter electrodes) 64 are absorbed by the barriers 5 formed on the conductive black matrix 3. Thus images are not blurred by the needless emission of light by the fluorescent layers 6 other than those struck by the electron beams and images are displayed in a high quality. The effect of the field-emission display is the same even if the focusing electrodes 68 are omitted. The front plate of the present invention can be used in combination with the conventional back plates and there is no particular restriction on the back plate to be used in combination with the front plate of the present invention.

EXAMPLES

Concrete examples of the front plats in the foregoing embodiments will be described hereinafter.

Example 1

A two-layer thin film was formed on a 1.1 mm thick glass substrate by depositing a 400 Å thick chromium oxide film and a 1000 Å thick chromium film by sputtering processes. A 1.35 μm thick photoresist film of a photoresist (OFPR-800, commercially available from Tokyo Ouka Kogyo K.K.) was formed on the thin film. The photoresist film was exposed to light through a mask provided with rectangular apertures of 280 m×80 μm arranged at intervals of 110 μm with respect to a direction parallel to the width of the rectangular apertures and at intervals of 330 μm with respect to a direction parallel to the length of the rectangular apertures, and the exposed photoresist film was developed to form a patterned resist film. The thin film was etched through the patterned resist film with an etchant (MR-ES, commercially available from The Inktec Co.). Subsequently, the patterned resist film was removed, the etched thin film was cleaned to complete a 1400 Å thick black matrix.

A 50 μm thick dry resist film (NIT250, commercially available from Nichigoumonto K.K.) was laminated to the glass substrate so as to cover black matrix. The dry resist film was exposed to light through a mask provided with rectangular apertures of 280 μm×80 μm arranged at intervals of 110 μm with respect to a direction parallel to the width of the rectangular apertures and at intervals of 330 μm with respect to a direction parallel to the length of the rectangular apertures, the exposed dry resist film was developed to form a patterned resist film. The patterned resist film is provided with slots for forming barriers. Parts of the black matrix on which barriers are to be formed are exposed in the slots of the patterned resist film.

Nickel is deposited on the parts of the black matrix exposed in the slots of the patterned resist film by an electroplating process using the black matrix as a cathode and a plating bath (nickel sulfamate solution, available from Nippon Kagaku Sangyo K.K.) The patterned resist film was removed by treating the same with a 5% potassium hydroxide solution. Thus 50 μm high barriers were formed on the black matrix as shown in FIG. 1.

Red, green and blue fluorescent coating materials were prepared. First, the red fluorescent coating material was applied to the black matrix by a slurry process to form a red fluorescent coating film. The red fluorescent coating film was exposed through a mask provided with a predetermined pattern of openings for red fluorescent layers to light projected thereon through the back surface of the transparent substrate. Then, the exposed red fluorescent coating film was developed to form red fluorescent layers in the predetermined apertures of the black matrix. The foregoing processes were repeated using the green and the blue fluorescent coating materials to form green blue fluorescent layers in predetermined apertures of the black matrix. Then, the organic components of the fluorescent coating materials were removed by heating the red, the green and the blue fluorescent layers at 400° C. for 35 min. Thus a front plate as shown in FIG. 1 was completed.

The red, the green and the blue fluorescent coating material had the following compositions.

Red fluorescent coating material $Y_2O_2S$:Eu: 25 parts by weight

Polyvinyl alcohol: 2.5 parts by weight

Water: 72.35 parts by weight

Ammonium dichromate: 0.15 parts by weight

Green fluorescent coating material

ZnS:Cu: 25 parts by weight

Polyvinyl alcohol: 2.5 parts by weight

Water: 72.35 parts by weight

Ammonium dichromate: 0.15 parts by weight

Blue fluorescent coating material

ZnS:Ag: 25 parts by weight

Polyvinyl alcohol: 2.5 parts by weight

Water: 72.35 parts by weight

Ammonium dichromate: 0.15 parts by weight

The glass substrate of the thus fabricated front plate did not crack.

A back plate (cathode plate) was fabricated by a Spint process. a chromium thin film was formed on a 1.1 mm thick glass substrate by a sputtering process. A 1.35 μm thick photoresist film of a photoresist (OFPR-800, commercially available from Tokyo Ouka Kogyo K.K.) was formed on the chromium thin film. The photoresist film was exposed to light through a mask of a predetermined pattern, and the exposed photoresist film was developed to form a patterned resist film. The chromium thin film was etched through the patterned resist film with an etchant (MR-ES, commercially available from The Inktec Co.). Subsequently, the patterned resist film was removed, the etched chromium thin film was cleaned to complete 280 μm wide emitter electrodes arranged at pitches of 330 μm.

Subsequently, silicon dioxide was deposited by a vacuum evaporation process over the entire surface of the glass substrate so as to cover the emitter electrodes to form a 1 μm thick insulating layer. A chromium thin film was formed by a sputtering process on the insulating layer. A 1.35 μm thick photoresist film of a photoresist (OFPR-800, commercially available from Tokyo Ouka Kogyo K.K.) was formed on the chromium thin film. The photoresist film was exposed to light through a mask of a predetermined pattern, and the exposed photoresist film was developed to form a patterned resist film. The chromium thin film was etched through the patterned resist film with an etchant (MR-ES, commercially available from The Inktec Co.). Subsequently, the patterned resist film was removed, the etched chromium thin film was cleaned to complete gate electrodes. Pores were formed in the insulating layer by etching the insulating layer with buffer hydrofluoric acid, using the gate electrodes of chromium as a mask. An aluminum thin film was formed on the chromium thin film by an oblique evaporation process such that aluminum is not deposited in the pores. A molybdenum thin film was formed by a vacuum evaporation process so as to cover the aluminum thin film. Thus, conical emitter electrodes of molybdenum are formed in the pores. Then, the aluminum thin film was removed by a process using a peeling solution (mixed solution of 38 phosphoric acid/15 nitric acid/0.5 acetic acid/0.5 water) to complete a back plate.

The front and the back plate were disposed opposite to each other and aligned with each other with the respective surfaces of the glass substrates facing out and with a 1.3 mm thick spacer of a ceramic material held between the front and the back plate. The front plate, the back plate and the spacer were hermetically joined together with a low-temperature glass frit to seal a space enclosed by the front plate, the back plate and the spacer, and the sealed space was evacuated at a high vacuum to complete a field-emission display panel. A field-emission display was built by connecting a driving circuit to the field-emission display panel and images were displayed by the field-emission display. It was confirmed that the field-emission display produced gases scarcely and was highly reliable.

Example 2

A front plate was fabricated by the same method as that by which the front plate of Example 1 was fabricated, excluding the following conditions. The electroplating process for forming the barriers used a plating bath (Dainshiruba AG-PL30, commercially available from Daiwa Kasei K.K.) and deposited a 5 μm thick silver layer in the slots of the patterned resist film, and then nickel was deposited in the slots of the patterned resist film. Thus, 50 μm high barriers were formed on an intermediate layer of silver.

The glass substrate of the thus fabricated front plate did not crack. A field-emission display panel employing the front plate was fabricated, and a field-emission display was built by connecting a driving circuit to the field-emission display panel. Images were displayed by the field-emission display. It was confirmed that the field-emission display produced gases scarcely and was highly reliable.

Example 3

A two-layer thin film for forming a black matrix was formed on a 1.1 mm thick glass substrate by depositing a 400 Å thick chromium oxide film and a 1000 Å thick chromium film by sputtering processes. A two-layer film for forming an intermediate layer consisting of a 500 Å thick nickel thin film and a 1000 Å thick gold thin film was formed. A 1.35 μm thick photoresist film of a photoresist (OFPR-800, commercially available from Tokyo Ouka Kogyo K.K.) was formed on the thin film. The photoresist film was exposed to light through a mask provided with rectangular apertures of 280 μm×80 μm arranged at intervals of 110 μm with respect to a direction parallel to the width of the rectangular apertures and at intervals of 330 μm with respect to a direction parallel to the length of the rectangular apertures, and the exposed photoresist film was developed to form a patterned resist film. The gold thin film, the nickel thin film and the chromium thin film were etched with etchants shown below. Subsequently, the patterned resist film was removed, the etched thin films were cleaned to complete a 1400 Å thick black matrix and a 1100 Å thick intermediate layer.

Etchant for Etching Gold Thin Film 0.5 Iodine/0.9 potassium iodide/0.9 water/1 ethanol Etchant for Etching Nickel Thin Film 1 Nitric acid/1 water/0.1 hydrogen peroxide Etchant for Etching Chromium Thin Film MR-ES (The Inktec K.K.)

Barriers were formed on the intermediate layer and fluorescent layers were formed in the apertures of the black matrix by the same processes as that used for fabricating the front plate in Example 1 to complete a front plate in Example 3.

The glass substrate of the thus fabricated front plate did not crack. A field-emission display panel employing the front plate was fabricated, and a field-emission display was built by connecting a driving circuit to the field-emission display panel. Images were displayed by the field-emission display. It was confirmed that the field-emission display produced gases scarcely and was highly reliable.

Example 4

A front plate in Example 4 was fabricated by the same processes as those used for fabricating the front plate in Example 1, except that the following disperse plating bath was used. The front plate was provided with barriers of a material containing 10% by weight polytetrafluoroethylene particles.

Dispersion Plating Bath

Nickel sulfamate solution: 90 parts by weight

Polytetrafluoroethylene particles: 10 parts by weight (Mean particle size: 10 μm)

The glass substrate of the thus fabricated front plate did not crack. A field-emission display panel employing the front plate was fabricated, and a field-emission display was built by connecting a driving circuit to the field-emission display panel. Images were displayed by the field-emission display. It was confirmed that the field-emission display produced gases scarcely and was highly reliable.

Example 5

A front plate in Example 5 was fabricated by the same processes as those used for fabricating the front plate in Example 2, except that the fluorescent layer forming processes heated the fluorescent layers at 430° C.

The glass substrate of the thus fabricated front plate did not crack. A field-emission display panel employing the front plate was fabricated, and a field-emission display was built by connecting a driving circuit to the field-emission display panel and images were displayed by the field-emission display. It was confirmed that the field-emission display produced gases scarcely and was highly reliable.

Example 6

A front plate in Example 6 was fabricated by the same processes as those used for fabricating the front plate in Example 3, except that the fluorescent layer forming processes heated the fluorescent layers at 430° C.

The glass substrate of the thus fabricated front plate did not crack. A field-emission display panel employing the front plate was fabricated, and a field-emission display was built by connecting a driving circuit to the field-emission display panel and images were displayed by the field-emission display. It was confirmed that the field-emission display produced gases scarcely and was highly reliable.

Example 7

A front plate in Example 7 was fabricated by the same processes as those used for fabricating the front plate in Example 4, except that the fluorescent layer forming processes heated the fluorescent layers at 430° C.

The glass substrate of the thus fabricated front plate did not crack. A field-emission display panel employing the front plate was fabricated, and a field-emission display was built by connecting a driving circuit to the field-emission display panel and images were displayed by the field-emission display. It was confirmed that the field-emission display produced gases scarcely and was highly reliable.

As apparent from the foregoing description, according to the present invention, the front plate for a field-emission display includes the transparent substrate, the conductive black matrix provided with the plurality of apertures and formed on one of the surfaces of the transparent substrate, the plurality of conductive barriers formed at predetermined positions on the black matrix near the apertures, and the fluorescent layers formed in the apertures of the black matrix on the transparent substrate. Since the front panel does not need any anodes, the front panel can be easily fabricated. The conductive components of the front plate not provided with peculiar anodes are equipotential (anode potential), i.e., the conductive black matrix and the barriers are equipotential. In the field-emission display employing the front plate of the present invention, electron beams emitted by the electron emitting electrodes (emitter electrodes) triggered by the gate electrodes strike the fluorescent layers formed in the corresponding apertures of the black matrix to cause the fluorescent layers emit light to display images. Since the barriers formed on the conductive black matrix absorb emitted secondary electrons and scattered electrons of the electron beams emitted by the electron emitting elements (emitter electrodes), images are not blurred by the needless emission of light by the fluorescent layers other than those struck by the electron beams and images are displayed in a high quality. Since charges of the electrons absorbed by the barriers are dissipated through the black matrix, charges are not accumulated in the barriers.

Since the barriers are formed on conductive inorganic material, the barriers, differing barriers of a resin, such as a polyamide resin, of the conventional front panel, do not need to be coated with a metal thin film and hence the front panel of the present invention can be easily fabricated. Since the processes for forming the fluorescent layers are able to use high heating temperatures, luminance can be increased, durability can be enhanced owing to the reduction of discharged gases and reliability can be improved. Since the barriers do not discharge gases during the operation of the field-emission display employing the front plate of the present invention, the reliability of the field-emission display can be further improved.

The foregoing effects can be expected even if the black matrix is not conductive or the barriers are formed directly on the transparent substrate because the barriers are connected by the charge dissipating lines.

What is claimed is:

1. A front plate for a field-emission display, comprising:

a transparent substrate;

a conductive black matrix provided with a plurality of apertures and formed on one of surfaces of the transparent substrate;

a plurality of barriers formed at predetermined positions on the black matrix; and fluorescent layers formed in the apertures of the black matrix on the transparent substrate;

wherein the barriers are formed of a conductive inorganic material and are directly in contact with the black matrix.

2. The front plate according to claim 1, wherein the conductive inorganic material is one of or one of combinations of metals of a metal group including nickel, cobalt, copper, iron, gold, silver, rhodium, palladium, platinum and zinc, one of alloys each of some of the metals of the metal group, or one of or one of combinations of some metal oxides of a metal oxide group including indium-tin oxide, indium-zinc oxide and tin oxide.

3. The front plate according to claim 1 further comprising:

an intermediate layer formed between the barriers and the black matrix;

wherein the intermediate layer has a middle thermal or strength characteristic between those of the transparent substrate and the barriers.

4. The front plate according to claim 1, wherein the barriers are formed of a conductive inorganic material that contains particles having a coefficient of thermal expansion smaller than that of the conductive inorganic material.

5. A front plate for a field-emission display, comprising:

a transparent substrate;

a plurality of barriers formed at predetermined positions on one of the surfaces of the transparent substrate; and fluorescent layers formed in desired regions in parts, not provided with the barriers, of the transparent substrate;

wherein the barriers are formed of a conductive inorganic material, and the barriers are electrically connected by charge dissipating lines.

6. The front plate according to claim 5, wherein the inorganic conductive material is one of or one of combinations of metals of a metal group including nickel, cobalt, copper, iron, gold, silver, rhodium, palladium, platinum and zinc, one of alloys each of some of the metals of the metal group, or one of or one of combinations of some metal oxides of a metal oxide group including indium-tin oxide, indium-zinc oxide and tin oxide.

7. The front plate according to claim 5 further comprising:

a conductive intermediate layer formed between the barriers and the transparent substrate;

wherein the intermediate layer has a middle thermal or strength characteristic between those of the transparent substrate and the barriers.

8. The front plate according to claim 5 further comprising:

a black matrix formed between the barriers and the transparent substrate;

wherein the black matrix has a plurality of apertures, and the fluorescent layers are formed in the apertures on the transparent substrate.

9. The front plate according to claim 8 further comprising:

a conductive intermediate layer formed between the barriers and the black matrix;

wherein the intermediate layer has a middle thermal or strength characteristic between those of the transparent substrate and the barriers.

10. The front plate according to claim 7, wherein the barriers are formed of a conductive inorganic material that contains particles having a coefficient of thermal expansion smaller than that of the conductive inorganic material.

11. The front plate for a field-emission display, according to claim 1, wherein the barriers have a height in the range of 20 to 100 $\mu$m and a width in the range of 10 to 50 $\mu$m.

* * * * *